US005471200A

United States Patent [19]

Romine

[11] Patent Number: 5,471,200

[45] Date of Patent: Nov. 28, 1995

[54] SMOKE DETECTOR PROTECTOR

[76] Inventor: Kindrick W. Romine, 511 Stack St., St. Pauls, N.C. 28384

[21] Appl. No.: 229,764

[22] Filed: Apr. 19, 1994

[51] Int. Cl.[6] ..... G08B 17/10

[52] U.S. Cl. ..... 340/628; 340/693

[58] Field of Search ..... 340/628, 629, 340/630, 693

[56] References Cited

U.S. PATENT DOCUMENTS

| | | | |
|---|---|---|---|
| 4,258,291 | 3/1981 | Scott | 315/156 |
| 4,287,517 | 9/1981 | Nagel | 340/636 |
| 4,313,110 | 1/1982 | Subulak et al. | 340/527 |
| 4,358,760 | 11/1982 | Palmer | 340/586 |
| 4,540,980 | 9/1985 | Porco | 340/586 |
| 4,654,953 | 4/1987 | Hobbs | 483/33 |
| 4,679,037 | 7/1987 | Bryan et al. | 340/693 |
| 4,975,688 | 12/1990 | Gonzales | 340/693 |
| 5,117,223 | 5/1992 | Tanner | 340/693 |
| 5,264,668 | 11/1993 | Rizzo | 181/205 |
| 5,303,029 | 4/1994 | Sioma et al. | 356/339 |

*Primary Examiner*—John K. Peng
*Assistant Examiner*—Julie Lieu
*Attorney, Agent, or Firm*—John G. Mills and Associates

[57] ABSTRACT

This invention is a protector for smoke detectors that can be mounted in atmospheres that have heavy airborne pollution that would normally cause a detector to malfunction. The protector is an enclosure including automated means for opening and closing the door for the Smoke Detector Protector that is relatively airtight when closed to prevent the ambient airborne particles from entering the same. Once the heavy concentration of airborne pollutants caused by manufacturing operations, etc. have been adequately reduced to a level that malfunctioning will not occur, such as when the manufacturing operations have ceased, then the enclosure will be opened to expose the enclosed smoke detector to the ambient atmosphere. Should a fire then occur, the smoke therefrom could be readily detected, and through the normal operation of the smoke detector, an alarm can be signalled.

6 Claims, 2 Drawing Sheets

SMOKE DETECTOR PROTECTOR

FIELD OF INVENTION

This invention relates to alarm systems and more particularly to smoke alarms and devices to protect the same.

1. Background of Invention

Industry has always had a need for sounding an alarm in case of fire. One of the fastest acting and least expensive systems available today are smoke detectors.

In a relatively clean atmospheric environment such as homes, retail businesses and the like smoke detectors work very well. In many industrial applications such as textile mills, woodworking shops, as well as in relatively wet environments such as slaughter houses, meat packing plants, paper mills and the like where airborne particles of lent, dust, moisture, mist, etc. are in evidence, a smoke detector will false alarm which makes their use completely unacceptable in such environments.

As long as workers are around during normal working hours, any excessive smoke or fire will quickly be detected and an alarm sounded. On the other hand, when the industry is not operating such as at night, on weekends, or on holiday smoke detection is needed since there are no workers to report smoke and fire. Since, however, it is well known that smoke detectors are useless in these industrial environments, they are not available during the period when they are most needed.

2. Concise Explanation of Prior Art References

U. S. Pat. No. 5,117,223 to Tanner is considered of interest in that it discloses a portable alarm system for a construction site and includes a cabinet, a stanchion supporting the cabinet and an alarm unit. When not in use, the stanchion and alarm are stored within the cabinet.

U. S. Pat. No. 5,264,668 to Rizzo is considered of interest in that it discloses a smoke detector muffling device which, once inserted over the smoke alarm, will prevent the same from receiving airborne particles in the smoke detector chamber which might set the same off.

U. S. Pat. No. 4,975,688 to Gonzales is considered of interest in that it discloses a particle detector disabling and protecting system that covers the detector and protects the same from ambient particulate material that might otherwise set the detector off.

The remaining U.S. Pat. Nos. 4,679,037 to Bryan et al, 4,258,291 to Scott, 4,286,517 to Nagel, 4,313,110 to Subulak et al, and 4,358,760 to Palmer awe all considered of general interest in that they disclose various alarm deactivating systems but do not address the problem of airborne particulate material released during normal industrial operations that cause smoke detectors to malfunction.

BRIEF DESCRIPTION OF INVENTION

After much research and study into the above-mentioned problems, the present invention has been developed to provide a means for protecting smoke detectors from airborne contamination during normal industrial operations while at the same time exposing the detectors to ambient atmosphere when the airborne contaminates are no longer present.

The above is accomplished by providing a protective enclosure for the smoke detector when the levels of airborne contamination are high while allowing the enclosure to be opened to expose the smoke detector to ambient atmosphere when the airborne contaminates in such ambient atmosphere have been reduced to an acceptable level.

In most industrial environments where there is a danger of fire caused by electrical equipment or in moist environments where there is a danger of electrical shock, pneumatic systems are installed to operate as much equipment as possible since pneumatic equipment generally will not start fires and certainly will not pose a danger of electrical shock.

Should the ambient environment be such that a pneumatic system not be required for safety purposes, the trap door manipulating means can be wired for electrical solenoid operation.

When an industrial plant begins operation, the pneumatic system is charged, usually between 60 and 110 pounds per square inch or psi. The smoke detector protectors of the present invention are operatively connected to this pneumatic system so that as long as pressure is maintained, the protector enclosure is closed.

When the industrial operation is cease operation at night, on the weekend, on holidays or at other times, the pneumatic system is ordinarily shut down after all industrial operations have ceased. It, of course, takes time for the pneumatic system to bleed off pressure. While this pressure is dropping, the airborne contaminates are also precipitating out of the air in the plant. By the time the pneumatic system has bled off enough pressure to allow the smoke detector protector of the present invention, which is biased to open position, to open, there are not enough air contaminates present to cause malfunctioning of the smoke detector. If, however, a fire is started in the plant after it is, closed the smoke detectors that are now exposed to the ambient atmosphere will sense smoke and set off the fire alarm.

In view of the above it is an object of the present invention to provide a smoke detector protector that is normally sealed closed during industrial operations and opens automatically when such operations cease.

Another object of the present invention is to provide a smoke detector that automatically closes when industrial operations are begun and automatically opens when such operations cease.

Another object of the present invention is to provide a simple, relatively inexpensive and yet highly efficient means of providing smoke detector fire alarm protection in areas of normal high particulate contamination during industrial operations, after such operations cease.

Another object of the present invention is to provide a smoke detector protector that is normally biased open but is held in sealed, closed condition when the associated industrial pneumatic system is in operation.

Other objects and advantages of the present invention will become apparent and obvious from a study of the following description and accompanying drawings which are merely illustrative of such invention.

DETAILED DESCRIPTION OF INVENTION

Figure 1:
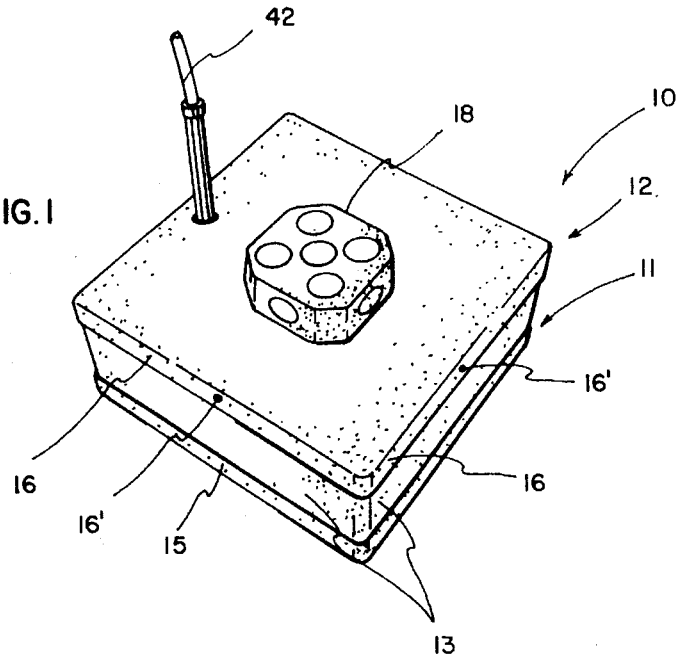
FIG. 1 is a top perspective view of the smoke detector protector of the present invention.

The smoke detector protector of the present invention, indicated generally at 12, includes a base housing 11 and a housing cover 12.

The housing 11 includes vertical side walls 13 and a bottom 14. A flange-like reinforcing member 15 is provided at the juncture of the side walls 13 and the bottom 14 as can clearly be seen in the figs.

Figure 6:
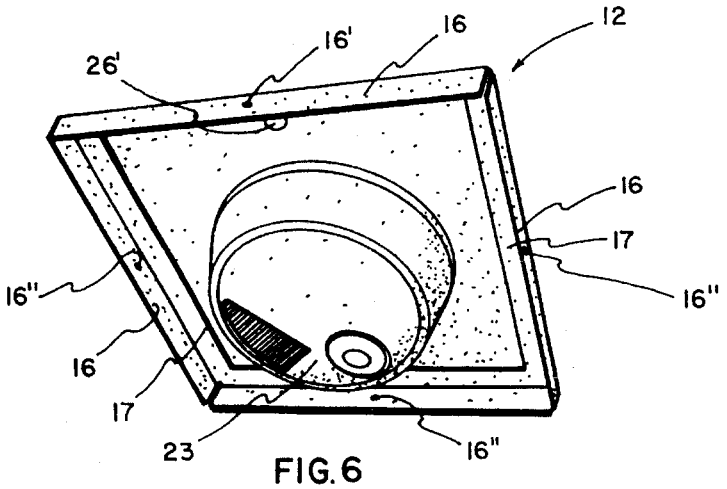
FIG. 6 is a perspective view of the interior of the housing cover.

The housing cover 12 has a downwardly extending lip 1,5 about its periphery. A sealing gasket 17 is provided on the inside of the cover 12 juxtaposed to lip 16 as can clearly be seen in FIG. 6.

A standard approved electrical box 18 is centrally mounted on the exterior of cover 12. This box is preferably of the weatherproof type which includes standard gaskets (not shown) for sealing the same. Also, an opening 26' is provided in the cover 12 which communicates with the interior thereof as will hereinafter be described in greater detail.

An opening 19 is provided in the bottom 14 of housing 11. A ceiling gasket 20 is provided on the exterior of bottom 14 about the periphery of opening 19 as can clearly be seen in FIG. 2. A trap door 21 is hingedly connected to the exterior of housing bottom 14 by means such as piano hinge 22. This trap door sealingly engages gasket 20 when in the closed position as will hereinafter be described in greater detail.

Electrical box 18 is open into the interior of cover 12 and a standard, readily available smoke detector 23 is operatively wired thereinto. Since the wiring of smoke detectors is well known to those skilled in the art, further detailed discussion of the same is not deemed necessary.

A cylinder mounting bracket 24 is provided on the interior of one of the side walls 13. An outwardly projecting flange 25 connects the mounting bracket 24 to a trap door manipulating mechanism such as air cylinder 26, The piston rod 27 of cylinder 26 has a bracket 28 outwardly extending to approximately 90° mounted thereon, A fulcrum bracket 29 is secured to the interior bottom 14 of housing 11 by means such as bolts 30, A pair of uprights 29 are adapted to mount the central portion of rocker arm 31 on fulcrum pin 32, One end of rocker arm 31 is pivotally attached to piston rod bracket 28 by pivot pin 33, The opposite end of rocker arm 31 has a bracket 34 secured thereto by means such as a rivet or bolt 36. The end of bracket 34 farthest from rocker arm 31 has a pivot pin 36 mounted thereon with one end of door actuating rod 37 pivotally attached thereto. The opposite end of rod 37 terminates in a T 38 which is adapted to slidingly engage slot 39 on opposite sides of door bracket 40.

The manner and mode of operation of the trap door actuating mechanism, indicated generally at 41, will hereinafter be described in greater detail.

To use the smoke detector protector 10 of the present invention, the electrical box 18 is mounted at a proper desired location such as in the ceiling of the plant. Since the mounting and wiring of electrical boxes are well known to those skilled in the art, further detailed discussion of the same is not deemed necessary.

Since the housing cover 12 is affixedly secured to the electrical box 18, such box supports the same.

Figure 4:
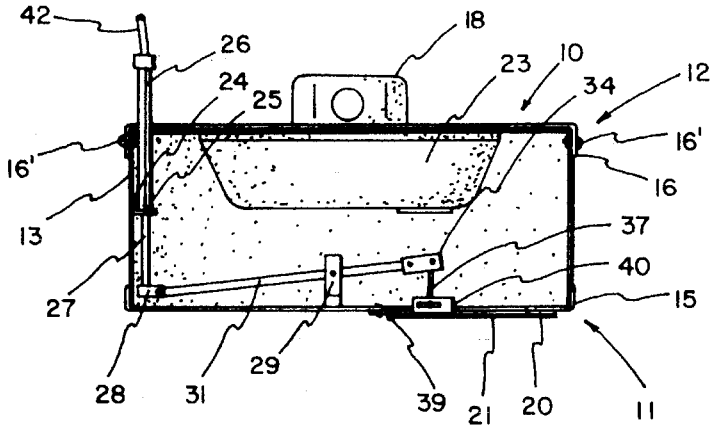
FIG. 4 is a cutaway side elevational view showing the trap door closed.
Figure 5:
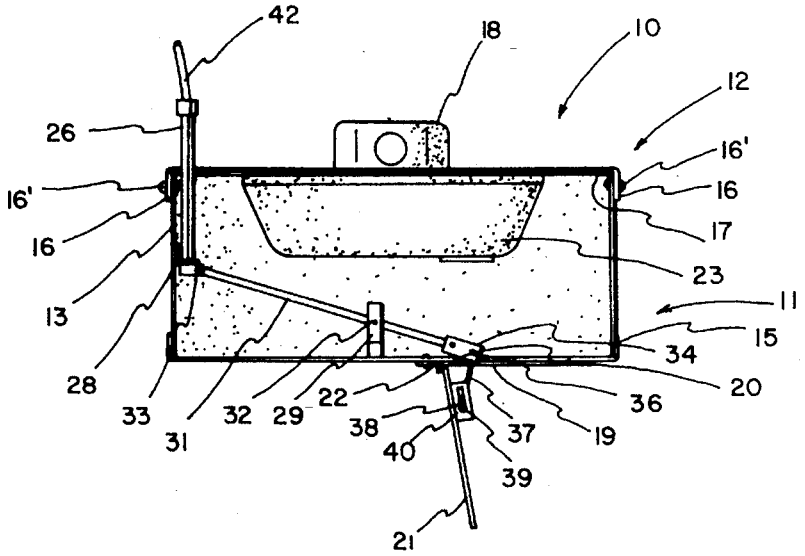
FIG. 5 is a cutaway side elevational view with the trap door open.

A trap door manipulating means such as air cylinder 26 is passed through opening 26' in cover 12 as the sides 13 of base housing 11 is pushed up into engagement with cover lip 16 as can clearly be seen in FIGS. 4 and 5. The edges of sides 13 will sealingly engage gasket 17 on the interior of lid 12 as can clearly be seen in FIG. 6.

Securing means such as self-tapping screws can be passed through openings 16" in lid lip 16 and into side walls 13 to securely hold the housing 11 and the cover 12 in sealed engagement with each other.

A pneumatic line 42 in operatively attached to air cylinder 26 at one end and to the plant air or vacuum system (not shown). Instead of using an air or vacuum system, other suitable trap door manipulating means such as a solenoid could be used to accomplish the desired results.

Figure 2:
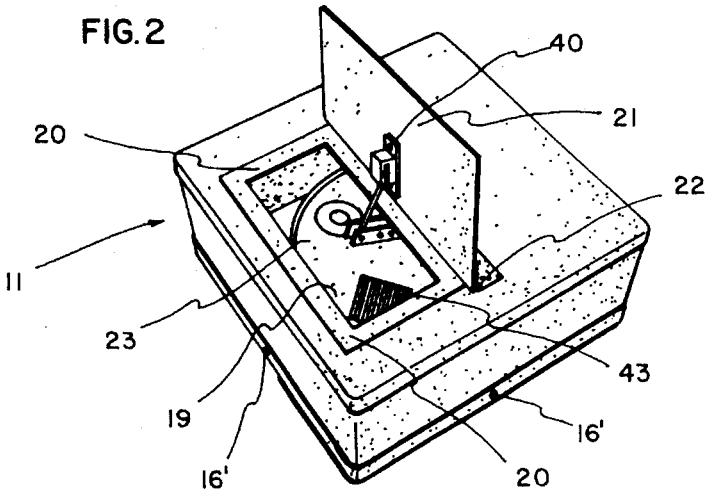
FIG. 2 is a bottom perspective view thereof with the protective door open.
Figure 3:
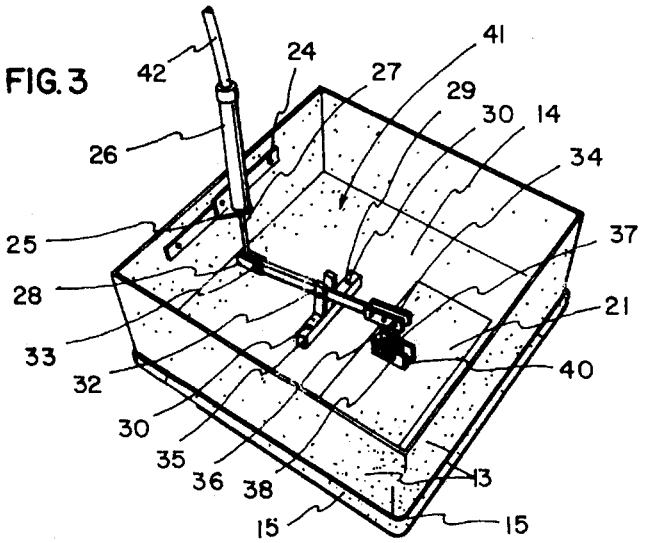
FIG. 3 is a top perspective view of the protector housing with the top portion thereof removed to show the door leveraging mechanism.

The trap door manipulating means 26 is normally bias with the piston rod retracted as shown in FIGS. 2 and 5.

Whenever the operating source of air, vacuum or electricity is applied, the piston rod overcomes the bias and moves to its extended position which pushes downwardly on one end of rocker arm 31. This in turn raises the other end of such arm, and through rod 37 and trap door bracket 40, will tightly close the trap door 21 against gasket 20 as can clearly be seen in FIG. 4.

Whenever the supply of activating energy such as air, vacuum or electricity is cut off, the normal bias of said manipulating means 26 will move the piston rod 27 up into the cylinder 26 to the position shown in FIG. 5. This in turn, through fulcrum 29 and rocker arm 31, will push door activating rod 37 downwardly to open the trap door 21. This open position is also illustrated in FIG. 2.

Once the trap door 21 is open to the position shown in FIGS. 2 and 5, this exposes the smoke detector chamber 43 of the smoke detector 23 to the ambient air. Should smoke from a fire enter the ambient air, it can now move into the smoke detector chamber 23 and in the normal manner of operation, a warning signal will be generated.

In plants and other environments where pneumatic systems are operated during normal working hours, the smoke detector protector of the present invention can be connected to such pneumatic system so that the trap door 21 in the housing 11 will normally be sealingly closed during the period of time that airborne pollutants are being created.

Once the plant ceases operation at the end of the workday, airborne pollutants will quickly precipitate out of the ambient air and when the pneumatic system is cut off, the normal bias of the trap door manipulating means will open the trap door so that should a fire occur during off hours, the smoke alarm can sense smoke in the ambient air and signal a warning. During normal working hours, of course, workers are around so there is no need for operating the smoke detectors.

Should a pneumatic system, with compressed air or vacuum, not be readily available, or if otherwise desired, the trap door manipulating means can be electrically wired for solenoid operation in the same manner as described for the pneumatic systems.

From the above it can be seen that the present invention provides a simple, relatively inexpensive and yet highly-efficient means for protecting smoke detectors during high ambient air pollution that would cause such smoke detectors, if unprotected, to false alarm. When the airborne pollutants are sufficiently reduced, such as ceasing of the manufacturing operations that create the airborne pollutants, the protective housing opens to expose the smoke detector to the ambient atmosphere so that should a fire start, the smoke can be sensed and an alarm sounded.

The terms "upper", "lower", "side", "top", "bottom", etc. have been used herein merely for convenience to describe the present invention and its parts as oriented in the drawings. It is to be understood, however, that these terms are in no way limiting to the invention since such invention may obviously be exposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A smoke detector protector comprising: an enclosure for preventing airborne particles in the ambient air from entering such enclosure; a smoke detecting means operatively mounted within said enclosure; and automated means for exposing the interior of said enclosure and its smoke detecting means to the ambient air whereby when airborne pollutants in the ambient air are of sufficient concentration to cause the smoke detecting means to false alarm, the enclosure will protect such smoke detecting means from such pollution, and when the concentration of airborne pollutants is sufficiently reduced so as not to cause malfunctioning false alarms, said smoke detecting means will be exposed to the ambient atmosphere so that in case of fire, the smoke therefrom can be sensed and an alarm sounded.

2. The smoke detector protector of claim 1 wherein the automated means for exposing the interior of said enclosure to the ambient air is a trap door type means.

3. The smoke detector protector of the claim 1 wherein the automated means for exposing the interior of said enclosure to the ambient air is a vacuum cylinder operatively connected to a closure that is normally biased to an open position.

4. The smoke detector protector of claim 1 wherein the automated means for exposing the interior of said enclosure to the ambient air is a compressed air cylinder operatively connected to a closure that is normally biased to an open position.

5. The smoke detector protector of claim 1 wherein the automated means of exposing the interior of said enclosure to the ambient air is an electrical solenoid operating connected to a closure that is normally biased to an open position.

6. The smoke detector protector of claim 1 wherein said enclosure is mounted on an electrical box.

* * * * *